US007392611B2

(12) United States Patent
Curry

(10) Patent No.: US 7,392,611 B2
(45) Date of Patent: Jul. 1, 2008

(54) APPARATUS AND METHOD FOR FIREARM TAKEDOWN

(75) Inventor: Brett Curry, Chicopee, MA (US)

(73) Assignee: Smith & Wesson Corp., Springfield, MA (US)

( * ) Notice: Subject to any disclaimer, the term of this patent is extended or adjusted under 35 U.S.C. 154(b) by 90 days.

(21) Appl. No.: 11/315,547

(22) Filed: Dec. 22, 2005

(65) Prior Publication Data

US 2006/0249014 A1 Nov. 9, 2006

Related U.S. Application Data

(60) Provisional application No. 60/639,187, filed on Dec. 22, 2004, provisional application No. 60/638,753, filed on Dec. 22, 2004, provisional application No. 60/638,752, filed on Dec. 22, 2004, provisional application No. 60/638,751, filed on Dec. 22, 2004, provisional application No. 60/638,746, filed on Dec. 22, 2004, provisional application No. 60/638,594, filed on Dec. 22, 2004, provisional application No. 60/638,593, filed on Dec. 22, 2004, provisional application No. 60/638,592, filed on Dec. 22, 2004.

(51) Int. Cl.
*F41A 19/00* (2006.01)

(52) U.S. Cl. ..... 42/69.01; 42/108; 42/106

(58) Field of Classification Search ..... 42/106, 42/90, 108, 69.01, 69.02, 69.03
See application file for complete search history.

(56) References Cited

U.S. PATENT DOCUMENTS 3,745,881 A * 7/1973 Roy ..... 89/163
3,756,120 A * 9/1973 Roy ..... 89/163
4,011,678 A 3/1977 Brodbeck et al.
4,031,648 A 6/1977 Thomas
4,275,640 A * 6/1981 Wilhelm ..... 89/147
4,522,105 A 6/1985 Atchisson
4,539,889 A 9/1985 Glock
4,681,020 A * 7/1987 Polanecky ..... 89/138
4,825,744 A 5/1989 Glock
4,893,546 A 1/1990 Glock
4,967,724 A 11/1990 Senfter
5,012,604 A 5/1991 Rogers
5,018,292 A 5/1991 West
5,024,139 A 6/1991 Knight, Jr. et al.
5,036,612 A 8/1991 Jennings
5,050,480 A 9/1991 Knight, Jr. et al.
5,050,481 A 9/1991 Knight, Jr. et al.
5,081,780 A 1/1992 Lishness et al.
5,086,578 A 2/1992 Lishness et al.

(Continued)

*Primary Examiner*—Michael J. Carone
*Assistant Examiner*—Stewart T Knox
(74) *Attorney, Agent, or Firm*—McCormick, Paulding & Huber LLP

(57) ABSTRACT

An improved firearm takedown mechanism is provided, which in a retention position prevents removal of both a slide and barrel assembly and a trigger assembly, but when manually positioned out of the retention position allows easy removal of both the slide and barrel assembly and the trigger assembly without the use of tools. A firearm takedown mechanism is provided having a first element with opposing ends separated by a longitudinal axis with a major and minor surface extending outwardly from the axis, and respectively adapted to prevent and allow removal of a slide and barrel assembly. An improved method for firearm takedown provides that after moving a takedown mechanism from a retention position, both a slide and barrel assembly and a trigger assembly are manually removed.

6 Claims, 4 Drawing Sheets

U.S. PATENT DOCUMENTS 5,086,579 A * 2/1992 Flatley et al. ..... 42/70.08
5,088,222 A 2/1992 Larson
5,090,147 A 2/1992 Pastor
5,105,570 A 4/1992 Lishness et al.
5,115,588 A 5/1992 Bronsart et al.
5,119,634 A 6/1992 Berry et al.
5,149,898 A 9/1992 Chesnut et al.
5,157,209 A 10/1992 Dunn
5,160,796 A 11/1992 Tuma et al.
5,164,534 A 11/1992 Royster
5,166,458 A 11/1992 Yoo
5,187,312 A 2/1993 Osborne
5,195,226 A 3/1993 Bornancini
5,216,191 A 6/1993 Fox
5,216,195 A 6/1993 Tuma
5,225,612 A 7/1993 Bernkrant
5,235,770 A 8/1993 Simon et al.
5,241,769 A 9/1993 Von Muller
5,247,757 A 9/1993 Deeb
5,251,394 A * 10/1993 Bornancini ..... 42/70.05
5,267,407 A * 12/1993 Bornancini ..... 42/70.08
5,272,957 A 12/1993 Chesnut et al.
5,299,374 A 4/1994 Mathys
5,303,494 A * 4/1994 Tuma et al. ..... 42/70.04
5,327,810 A 7/1994 Sandusky et al.
5,349,939 A 9/1994 Perrone
5,355,768 A 10/1994 Felk
5,373,775 A 12/1994 Findlay, Sr. et al.
5,386,659 A 2/1995 Vaid et al.
5,388,362 A 2/1995 Melcher
5,400,537 A 3/1995 Meller et al.
5,412,894 A 5/1995 Moon
5,417,001 A 5/1995 Rousseau
5,426,881 A 6/1995 Ruger
5,438,784 A * 8/1995 Lenkarski et al. ..... 42/70.02
5,448,939 A 9/1995 Findlay, Sr. et al.
5,487,233 A 1/1996 Jewell
5,493,806 A * 2/1996 Langevin et al. ..... 42/69.02
5,502,914 A 4/1996 Moon
5,517,896 A 5/1996 Perrine
5,517,987 A 5/1996 Tsuchiya
5,548,914 A 8/1996 Anderson
5,570,527 A 11/1996 Felicci
5,581,927 A 12/1996 Meller
5,604,326 A 2/1997 Lescure
5,606,825 A 3/1997 Olsen
5,615,507 A * 4/1997 French ..... 42/69.02
5,623,114 A * 4/1997 Soper ..... 89/141
5,625,971 A 5/1997 Tuma et al.
5,634,456 A 6/1997 Perrone
5,635,664 A 6/1997 Pons et al.
5,640,794 A 6/1997 Gardner et al.
5,655,326 A 8/1997 Levavi et al.
5,669,169 A 9/1997 Schmitter et al.
5,680,722 A 10/1997 French et al.
5,697,178 A 12/1997 Haskell
5,701,698 A 12/1997 Wesp et al.
5,709,046 A 1/1998 Canaday
5,711,286 A 1/1998 Petrosyan et al.
5,713,150 A 2/1998 Ealovega
5,717,156 A 2/1998 Lenkarski
5,718,074 A 2/1998 Keeney
5,736,667 A 4/1998 Munostes et al.
5,760,328 A 6/1998 Robbins
5,770,814 A 6/1998 Ealovega
5,778,585 A 7/1998 Sigg
5,797,206 A 8/1998 Vitorino
5,806,225 A 9/1998 Gardner et al.
5,815,973 A 10/1998 Hochstrate
5,826,362 A 10/1998 Lyons
5,834,678 A 11/1998 Kalb
5,852,891 A 12/1998 Onishi et al.
5,857,280 A 1/1999 Jewell
5,906,066 A 5/1999 Felk
5,913,261 A 6/1999 Guhring et al.
5,974,717 A 11/1999 Brooks
5,987,796 A 11/1999 Brooks
6,000,162 A 12/1999 Hochstrate
6,070,512 A 6/2000 Rohrbaugh
6,125,735 A 10/2000 Guhring
6,131,324 A 10/2000 Jewell
6,134,852 A 10/2000 Shipman et al.
6,164,001 A 12/2000 Lee
6,205,694 B1 3/2001 Davis, Sr.
6,240,669 B1 6/2001 Spaniel et al.
6,241,769 B1 * 6/2001 Nicholson et al. ..... 623/17.11
6,253,479 B1 7/2001 Fuchs et al.
6,256,918 B1 7/2001 Szabo
6,256,920 B1 7/2001 Olson
6,263,607 B1 * 7/2001 Fuchs et al. ..... 42/75.01
6,266,909 B1 * 7/2001 Fuchs et al. ..... 42/75.01
6,272,683 B1 8/2001 Symms et al.
6,272,783 B1 8/2001 Dumortier et al.
6,289,619 B1 9/2001 Fuchs et al.
6,293,039 B1 9/2001 Fuchs
6,341,442 B1 1/2002 Szabo et al.
6,354,032 B1 3/2002 Viani
6,367,186 B1 4/2002 Gibala
6,381,892 B1 * 5/2002 Szabo et al. ..... 42/70.08
6,382,200 B1 5/2002 Levkov
6,405,631 B1 6/2002 Milek
6,412,206 B1 7/2002 Strayer
6,415,702 B1 * 7/2002 Szabo et al. ..... 89/148
6,425,199 B1 7/2002 Vaid et al.
6,448,939 B2 9/2002 Maruta
6,506,731 B1 * 1/2003 Sandberg et al. ..... 514/15
6,513,273 B2 * 2/2003 da Silveira ..... 42/70.08
6,519,887 B1 2/2003 Allen et al.
6,526,684 B1 3/2003 Hickerson
6,539,658 B1 4/2003 Hubert et al.
6,543,169 B2 4/2003 Bero
6,553,706 B1 4/2003 Gancarz et al.
6,557,288 B2 5/2003 Szabo
6,560,909 B2 * 5/2003 Cominolli ..... 42/70.05
6,588,136 B2 * 7/2003 Baker et al. ..... 42/70.05
6,591,536 B2 * 7/2003 Houde-Walter et al. ..... 42/114
6,601,331 B2 8/2003 Salvitti
6,615,527 B1 9/2003 Martin
6,640,478 B2 11/2003 Johansson
6,643,968 B2 11/2003 Glock
6,655,066 B2 12/2003 Fluhr
6,665,973 B1 12/2003 Peev
6,688,210 B2 2/2004 Bubits
6,705,036 B2 3/2004 Orr
6,711,824 B2 3/2004 Hruska
6,711,842 B1 3/2004 Chapman
6,718,680 B2 * 4/2004 Roca et al. ..... 42/70.08
6,732,464 B2 5/2004 Kurvinen
6,735,897 B1 5/2004 Schmitter et al.
6,769,208 B2 8/2004 Beretta
6,789,342 B2 9/2004 Wonisch et al.
2002/0194767 A1 * 12/2002 Houde-Walter et al. ..... 42/114
2006/0064914 A1 * 3/2006 Greer ..... 42/77

* cited by examiner

APPARATUS AND METHOD FOR FIREARM TAKEDOWN

This application claims the benefit of the following U.S. Provisional Applications: Ser. No. 60/639,187; Ser. No. 60/638,594; Ser. No. 60/638,753; Ser. No. 60/638,593; Ser. No. 60/638,746; Ser. No. 60/638,592; Ser. No. 60/638,751; and Ser. No. 60/638,752, all filed Dec. 22, 2004, and all hereby incorporated by reference herein in their entireties.

FIELD OF THE INVENTION

The present invention relates generally to a take down apparatus for a semiautomatic pistol or handgun and, more particularly, to a take down apparatus that facilitates the separation of a slide of the handgun from a frame of the handgun and a method of taking down a handgun using the apparatus.

BACKGROUND OF THE INVENTION

Field stripping a semiautomatic handgun typically involves removing a slide from a frame, removing a barrel from the slide, and removing a spring from the slide. Few, if any, tools are generally required for such a field stripping operation, which is most often performed for the purposes of routine maintenance and lubrication. Some firearms require that the arm be dry-fired prior to removal of the slide to properly set the fire control mechanism in preparation for field stripping. Some firearms also require that spring-loaded dips located on both sides of the slide be simultaneously compressed while the slide is being manipulated off the frame.

Disassembly of a firearm beyond the point of field stripping can (for some models) require several tools such as, for example, punches, hammers, screwdrivers, and pliers. The removal of a trigger assembly (which may include the trigger, a housing in which the trigger is pivotally mounted, and the trigger bar) is generally effected by pressing one or more retaining pins out of the frame from one side and prying the trigger assembly out.

From the foregoing it can be seen that there is a need for a simplified apparatus, and method for use thereof, that is incorporated into the structure of a handgun to allow for simplified disassembly of the handgun for field stripping or general maintenance or for the purposes of making modifications, repairs, or detailed maintenance. It can also be seen that there is a need for a firearm takedown apparatus and method that allow for easy removal of other firearm components, such as the trigger assembly.

SUMMARY OF THE INVENTION

The present invention, according to one embodiment, provides a firearm having removable slide/barrel and trigger assemblies, and a takedown mechanism which is manually positionable into and out of a retention position and adapted to prevent the removal of the slide/barrel and trigger assemblies when in the retention position and to allow removal of the slide/barrel and trigger assemblies when out of the retention position.

According to another embodiment, the present invention provides a takedown mechanism for a firearm, the takedown mechanism having a first member with first and second ends separated by a longitudinal axis and with a major and minor surface extending at least partially along the longitudinal axis, the major surface extending outward further than the minor surface, such that the major surface is adapted to prevent, the minor surface to allow, removal of a slide and barrel assembly.

The present invention also provides a method for firearm takedown by moving a takedown mechanism out of a retention position and, without the use of tools, stripping the slide and barrel assembly and removing the trigger assembly.

One advantage of an embodiment of the present invention is that the slide can be removed from a semiautomatic handgun having the herein described takedown mechanism using reduced effort. By incorporating the take down mechanism into the frame such that the slide can be easily removed, the handgun can be field stripped quickly and easily. The efficient field stripping of a handgun allows the cleaning and lubrication of the handgun parts to be less labor intensive.

Another advantage of an embodiment of the present invention is that the trigger assembly can be removed from a semiautomatic handgun having the takedown mechanism with little effort. By making the mechanism operable using finger pressure, the need for tools such as punches and hammers is obviated.

DETAILED DESCRIPTION

Figure 1:
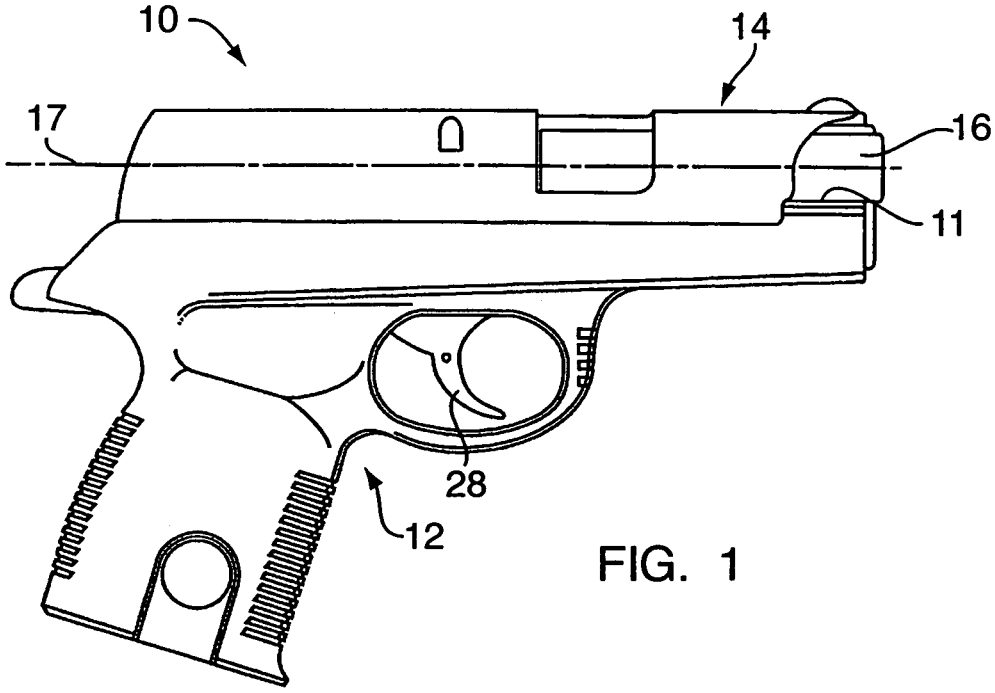
FIGS. 1 and 2 are simplified schematic views of a semiautomatic handgun showing the slide thereof in battery and retired positions, respectively.
Figure 2:
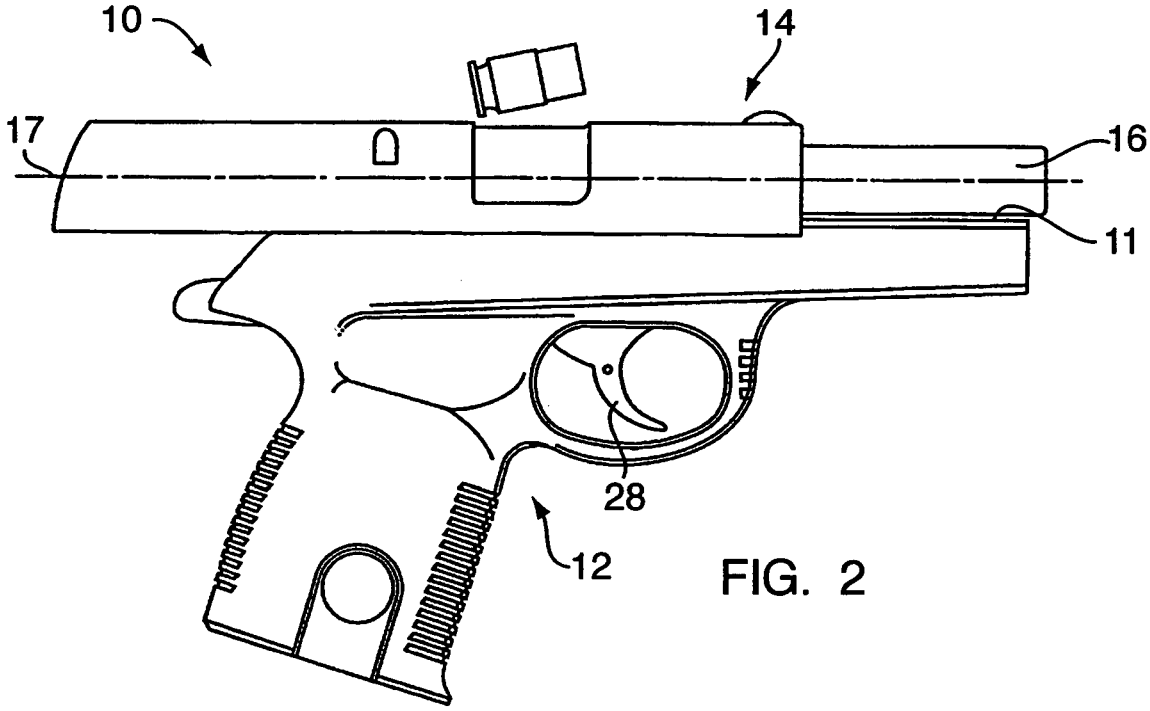

Referring to FIGS. 1 and 2, a semiautomatic pistol or handgun is shown generally at 10 and is hereinafter referred to as "handgun 10." The handgun 10 comprises a frame 12, a slide 14, a barrel 16, and a fire control mechanism (shown at 18 in FIG. 3). The barrel 16 is disposed at the front aperture of the slide 14 and is cooperatively linked therewith, and, together with the slide 14, defines a longitudinal firing axis 17. The barrel 16 has a rearward end adapted for receiving an ammunition cartridge. A trigger 28 is pivotally mounted to the frame 12 to actuate the fire control mechanism to fire the handgun 10. The frame 12 is fabricated of a high-impact polymer material, metal, or a combination of polymer and metal.

The slide 14 is fitted to opposingly positioned rails 11 of the frame 12 to effect the reciprocal movement of the slide 14 along the longitudinal firing axis 17. The rails 11 extend along the underside of the slide 14 in the longitudinal direction and are cooperative with the frame 12 to allow the cycling of the slide 14 between forward (battery) and rearward (retired) positions.

The cooperation of the frame 12, the slide 14, the barrel 16, and the firing mechanism during the loading, firing of a cartridge, and ejecting of a spent casing for a firearm of the present type can be understood by referring to U.S. Pat. No.

5,086,579 entitled "DECOCKING MECHANISM FOR A SEMI-AUTOMATIC FIREARM"; U.S. Pat. No. 5,386,659 entitled "FIRE CONTROL MECHANISM FOR SEMIAUTOMATIC PISTOLS"; and U.S. Pat. No. 5,406,731 entitled "HANDGUN OF IMPROVED ERGONOMIC CONSTRUCTION", all of which are owned by the Assignee of the present invention and are incorporated by reference herein.

Figure 3:
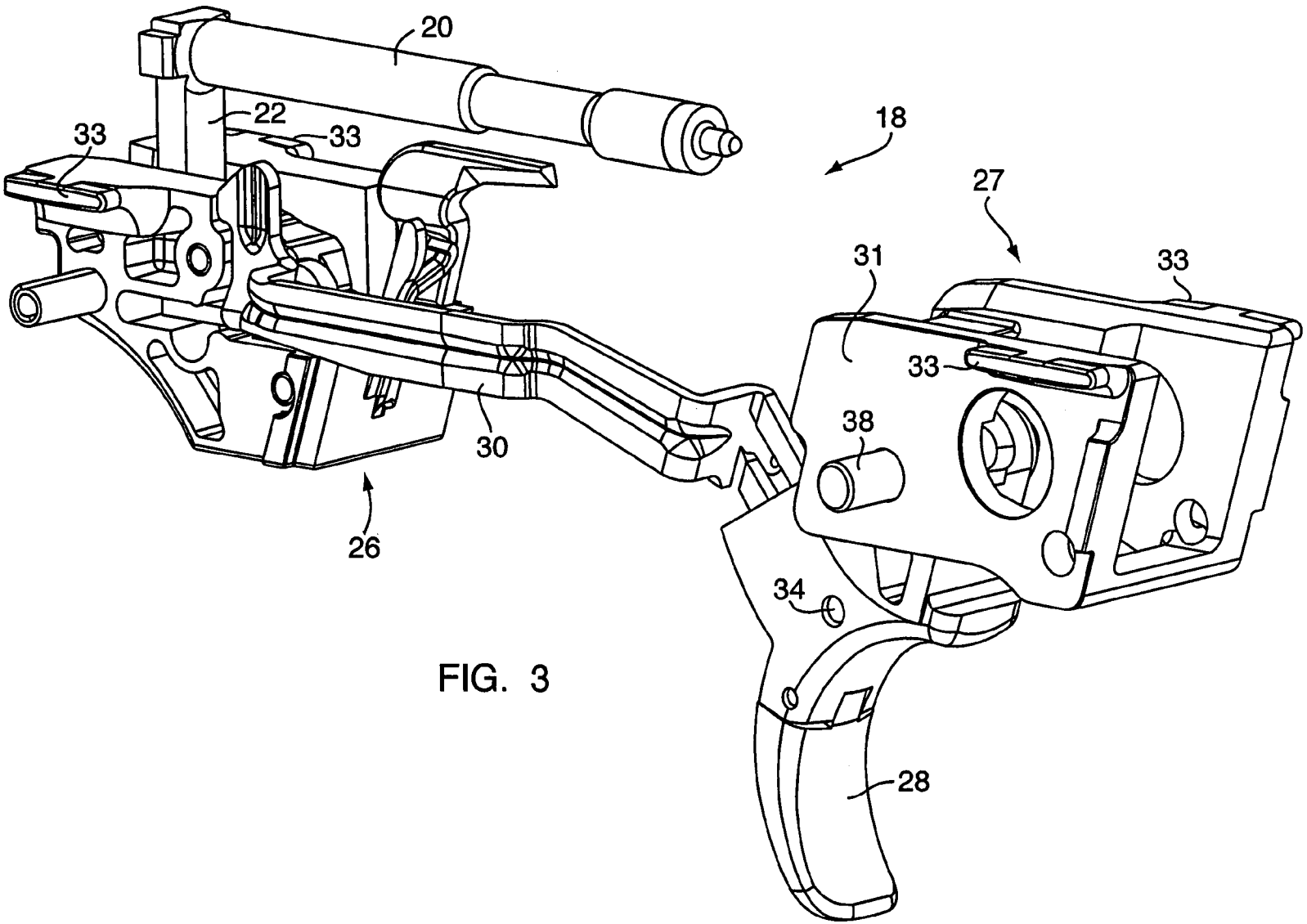
FIG. 3 is a simplified schematic perspective view of a fire control mechanism illustrating the take down mechanism of the present invention.

Referring now to FIG. 3, the fire control mechanism 18 is a striker-type firing pin such as is depicted in U.S. Pat. No. 5,386,659. A striker-type firing pin comprises a firing pin 20, a depending leg 22 extending from the firing pin 20, and a sear assembly 26 that is engagable by the firing pin 20. The sear assembly 26 is operably engagable with a trigger assembly 27 including the trigger 28 in a trigger housing 31. The trigger assembly 27 is operably connected to the sear assembly 26 via a trigger bar 30. Both the sear assembly 26 and the trigger housing 31 include guide members 33 that provide surfaces along which the slide can translate during cycling of the slide. Upon operation of the handgun (by movement of the trigger 28), a surface of the depending leg 22 selectively engages the sear assembly 26.

The trigger 28 may be of unitary construction, as shown, or of a multiple-piece articulated construction. The trigger 28 is pivotally connected to the trigger bar 30 via a trigger bar retention pin 34. The trigger bar 30 may be biased in lateral directions with a spring or the like. Rearward movement of the trigger 28 causes movement of the trigger bar 30 in a rearward longitudinal direction. When the trigger 28 is actuated by being pressed in a rearward direction, the trigger 28 pivots about a trigger pivot pin 38, thereby transmitting rearward longitudinal movement to the trigger bar 30 through the trigger bar retention pin 34. Longitudinal movement of the trigger bar 30 in a rearward direction, in turn, actuates the sear assembly 26 to cause a firing pin spring to decompress, thereby allowing the firing pin 20 to translate in a forward direction to engage a cartridge and fire the handgun.

Figure 4:
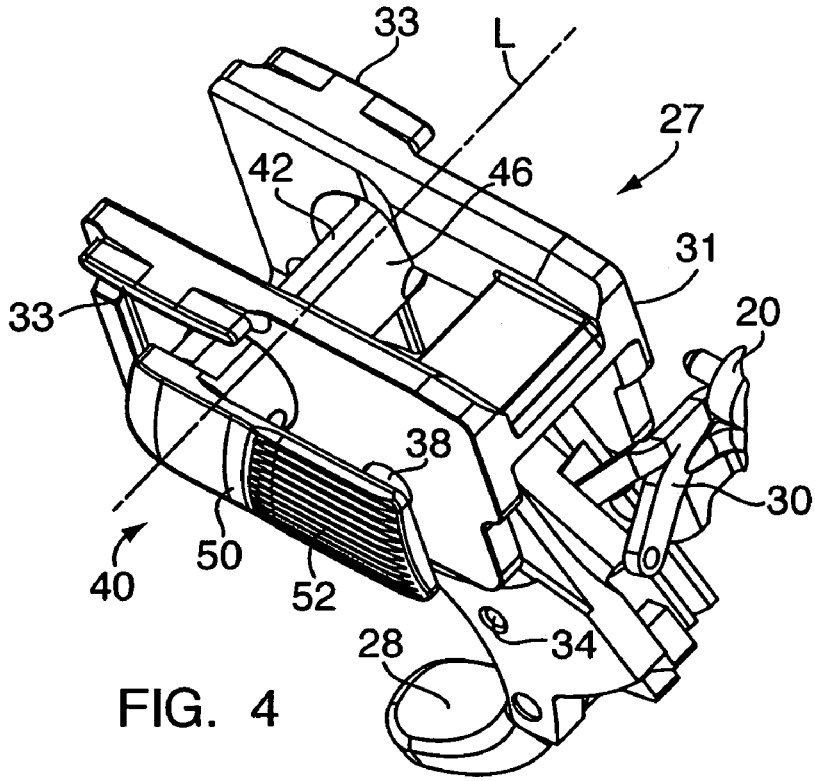
FIG. 4 is a simplified schematic perspective view of the take down mechanism of the present invention in which the handgun is operational.
Figure 5:
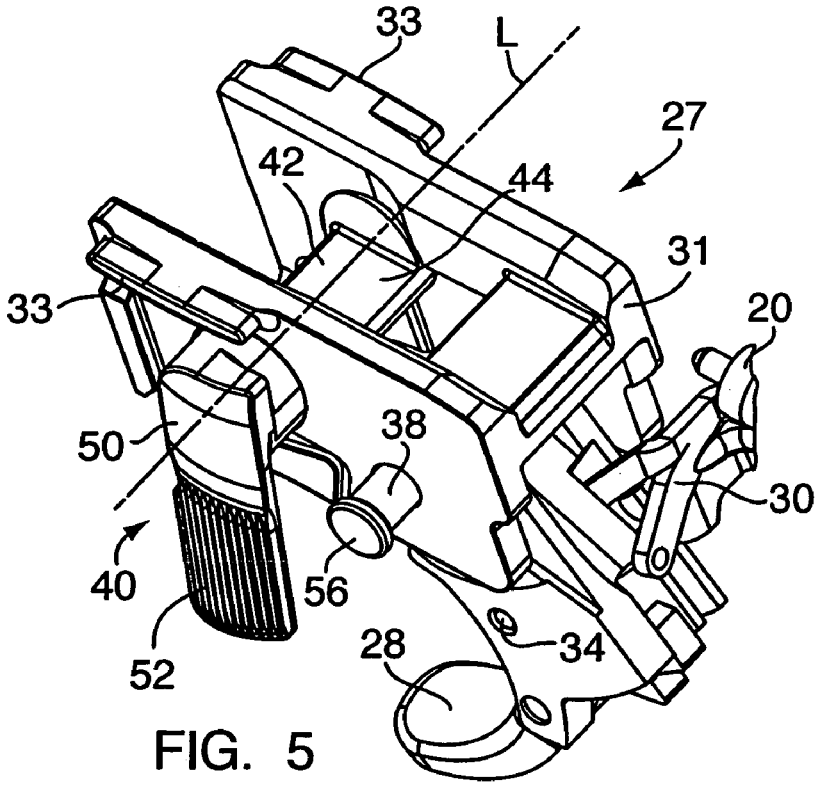
FIG. 5 is a simplified schematic perspective view of the take down mechanism of the present invention in which the handgun is prepared for a take down procedure.

Referring now to FIGS. 4 and 5, a take down means (takedown mechanism 40) is provided that allows for disassembly of the trigger assembly 27 and removal of the trigger 28 from the trigger housing 31 and the frame of the handgun. The take down mechanism 40 is shown as a take down pin (or first member) 42 laterally positioned through the trigger housing 31 and the frame. The take down pin 42 has one minor surface 44 that is substantially flat and which extends along at least a portion of a longitudinal axis L of the take down pin 42. The minor surface 44 is bounded at opposing edges thereof by at least one major surface 46 that is substantially rounded and that likewise extends along at least a portion of the longitudinal axis L of the take down pin 42. Thus, the take down pin 42 has a substantially circular- or elliptical cross-sectional geometry with one length of the edge of the cross-section being flattened. Alternatively, the take down pin 42 may have other functionally equivalent shapes, including two opposing minor surfaces 44 that are substantially flat and two alternately-positioned opposing major surfaces 46 to define a circular- or elliptical cross-sectional geometry having opposing lengths of the edge of the cross-section being flattened.

The take down mechanism 40 also has an ear (or second member) 50, one end of which is attached to one end of the take down pin 42. The ear 50 extends substantially radially from the longitudinal axis L of the take down pin 42 and has a surface 52 that can be engaged by a user and rotated about the longitudinal axis L using finger pressure. Preferably, the surface 52 is knurled or otherwise textured to facilitate rotation of the ear 50. The ear 50 preferably depends from an end of the take down pin 42 such that the ear 50 extends in the direction of one of the major surfaces 46.

Referring specifically to FIG. 5, the trigger pivot pin 38 serves as a trigger retention element and preferably has an enlarged end portion, shown as a cap 56, that has a larger diameter than the trigger pivot pin 38 itself, which thereby allows for the insertion and removal of the trigger pivot pin 38 from one side of the trigger housing 31 only. When the take down element 40 is properly mounted and the ear 50 is positioned to be substantially parallel to a bore axis of the handgun, the ear 50 obstructs the cap 56. Upon rotation of the ear 50 from over the cap 56 (in a retention position) to a downward position (e.g., a trigger assembly removal position of 90 degrees downward), the cap 56 is exposed, thereby allowing the trigger pivot pin 38 to be removed. The trigger pivot pin 38 may be fitted through the frame and the trigger housing 31 in an interference fit, which may require that the trigger pivot pin 38 be pressed out to effect its removal. Alternatively, the trigger pivot pin 38 may be loosely fit through the frame and the trigger housing 31, thereby allowing the trigger pivot pin 38 to slide freely out of its mounted position.

Figure 6:
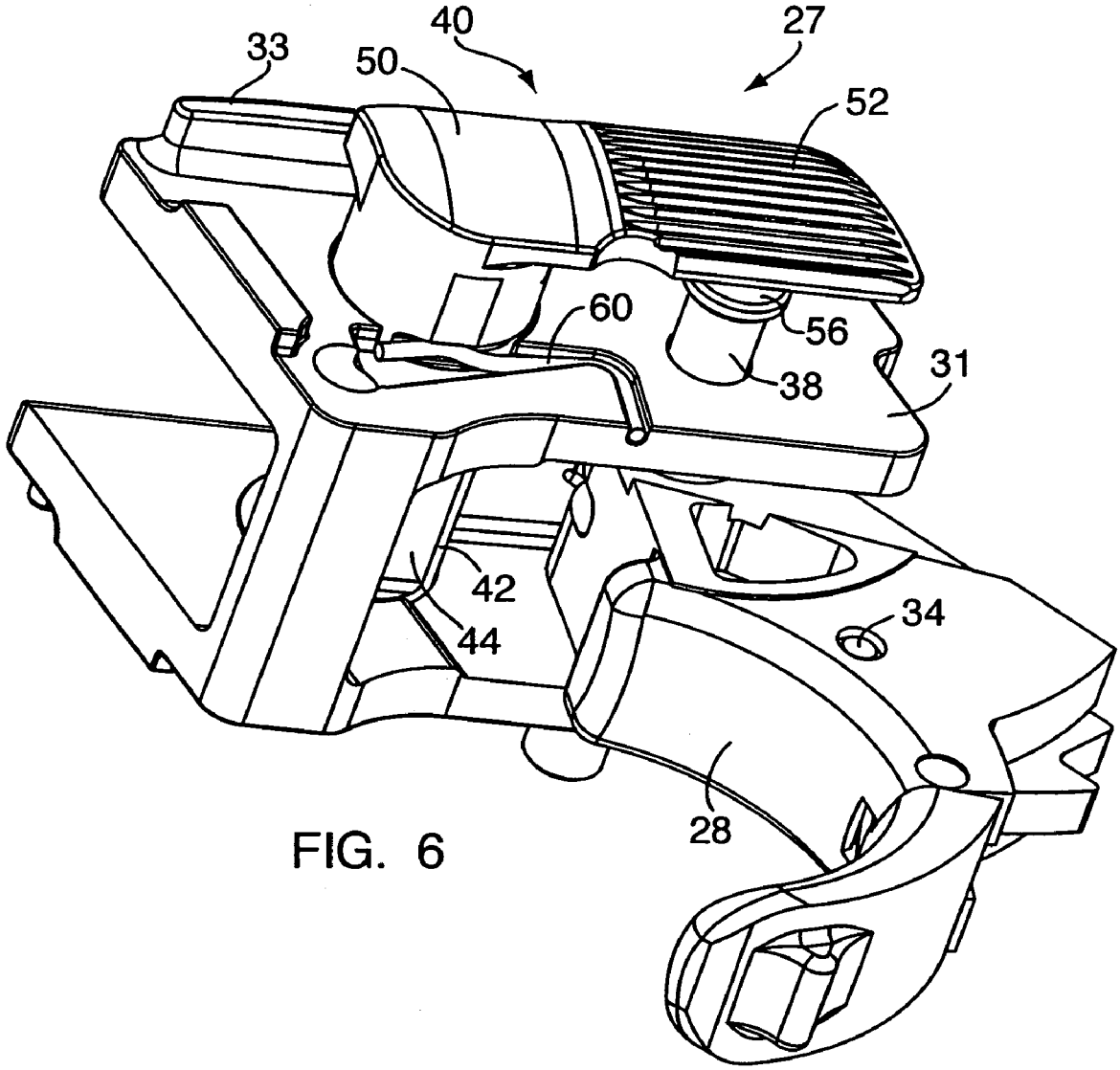
FIG. 6 is a simplified schematic perspective view of the take down mechanism of the present invention illustrating the retaining pin that holds the take down mechanism in a trigger housing.

Referring now to FIG. 6, a takedown mechanism retention element 60, shown as a retaining pin, is positioned in the trigger housing 31 to retain the take down element 40 in the trigger housing 31. The retaining pin 60 is received into a groove or channel that extends from a bottom portion of a hole through which the take down pin 42 of the take down element 40 is positioned and along an outer surface of the trigger housing 31. In one embodiment, the retaining pin 60 is a member (e.g., a substantially inflexible wire) that has a single 90-degree bend therein. Preferably, the retaining pin 60 snap fits into the groove or channel. When positioned in the groove or channel, the retaining pin 60 is also positioned in a corresponding groove or channel in the circumferential surface of the take down pin 42, thereby retaining the take down pin 42 in place. The retaining pin 60 may provide resistance to the rotation of the take down pin 42 in the hole through which the take down element 40 is mounted.

Referring to FIGS. 4-6, when the take down element 40 is positioned such that the ear 50 extends to the rear of the handgun, the minor surface 44 of the take down pin 42 faces forward (the direction in which the barrel extends). In embodiments in which the take down pin 42 comprises two opposing minor surfaces 44, the minor surfaces face both forward and rearward. The major surface(s) 46 are accordingly positioned to face up and/or down. When the major surface(s) 46 are positioned to face up and/or down (in a slide retention position), the upward-facing major surface 46 is positioned forward of a bottom, forward edge of a slide retention element, such as a lug, on the bottom of the barrel. Accordingly, when this major surface 46 extends upward and is forward of the bottom, forward edge of the lug, the lug (and the slide and barrel assembly) is prevented from moving forward in a stripping, or slide removal, direction. Thus, the assembly of the barrel and the slide cannot be removed from the frame. When the take down pin 42 is positioned (in a slide removal position) such that the major surface 46 extends in a direction that is parallel to the direction in which the slide moves (and the minor surface(s) 44 are facing up and/or down), forward movement of the bottom, forward edge of the lug is not obstructed, and the lug (and the slide and barrel assembly) are able to slide forward and off the frame.

Further, when the take down element 40 is positioned such that the ear 50 extends down, the cap 56 of the trigger pivot pin 38 is exposed and the trigger pivot pin 38 can be pressed in the direction of the cap 56 (the trigger retention element removal direction) from the opposing end to remove the trigger pivot pin 38 from the trigger housing 31, thereby allowing the trigger assembly 27 to be separated from the frame 12.

In operation, the takedown mechanism, or pin 42, is manually pivoted out of a retention position, thereby moving the major surface 46 out of the path of the slide retention element, or barrel lug, as well as moving the ear out of the path of cap 56. The trigger assembly retention element, or trigger pivot pin 38, is pushed out and the slide and barrel assembly is stripped. Due to the advantageous design and arrangement of the takedown mechanism, both the stripping of the slide and barrel assembly and the removal of the trigger assembly can be easily accomplished without the use of tools.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the above description.

What is claimed is:

1. A takedown mechanism for a firearm, said takedown mechanism comprising:

a first member rotatably connected to the firearm, said first member having a first and a second end separated by a longitudinal axis, and a major and a minor surface each extending at least partially along said longitudinal axis, said major surface extending further outward from said longitudinal axis than said minor surface, said major surface and minor surface preventing and allowing removal of a firearm slide and barrel assembly portion of the firearm, respectively; and a second member connected to the first end of the first member and unitary therewith for concerted movement with the first member, said second member extending outwardly from the longitudinal axis in a radial direction, wherein the second member (i) prevents a trigger pivot pin portion of the firearm from being removed from the firearm, when the major surface of the first member is positioned to prevent removal of the firearm slide and barrel assembly, through a direct blocking interaction between the second member and the trigger pivot pin, and (ii) allows the trigger pivot pin to be directly removed from the firearm when the minor surface is positioned to allow removal of the firearm slide and barrel assembly, without the need to remove other elements to access the pivot pin for removal, at least once the second member is accessed.

2. The takedown mechanism of claim 1, wherein said first member is rotatably connected to a frame portion of the firearm, for pivoting about said longitudinal axis.

3. The takedown mechanism of claim 2, wherein said first member is rotatably connected to a trigger housing portion of the firearm frame.

4. The takedown mechanism of claim 2, wherein said first member includes an at least partially circumferential groove engaged with a takedown mechanism retention element.

5. The takedown mechanism of claim 4, wherein the takedown mechanism retention element is engaged with a trigger housing portion of the firearm so as to retain said takedown mechanism in a firearm, and wherein the retention element is a generally L-shaped pin positioned in a generally L-shaped channel formed in the trigger housing.

6. A takedown mechanism for a firearm, said takedown mechanism comprising:

a pin member rotatably connected to the firearm, said pin member having a first end and a second end separated by a longitudinal axis, and a major and a minor surface each extending at least partially along said longitudinal axis, said major surface extending further outward from said longitudinal axis than said minor surface, said pin member being rotatable about said axis between a first position and a second position, wherein in the first position the major surface is oriented to prevent removal of a firearm slide and barrel assembly portion of the firearm, and wherein in the second position the minor surface is oriented to allow removal of the firearm slide and barrel assembly; and an ear connected to the first end of the pin member and unitary therewith for concerted movement with the pin member, said ear extending outwardly from the longitudinal axis in a radial direction, wherein the ear (i) prevents a trigger pivot pin portion of the firearm from being removed from the firearm when the pin member is in the first position, where the major surface of the pin member is positioned to prevent removal of the firearm slide and barrel assembly, through a direct blocking interaction between the ear and the trigger pivot pin, and (ii) allows the trigger pivot pin to be directly removed from the firearm when the pin member is in the second position, where the minor surface is positioned to allow removal of the firearm slide and barrel assembly, without the need to remove other elements to access the pivot pin for removal, said ear no longer being in direct blocking interaction with the trigger pivot pin when the pin member is in the second position.

* * * * *